United States Patent [19]

Corona et al.

[11] Patent Number: 4,774,546

[45] Date of Patent: Sep. 27, 1988

[54] APPARATUS FOR FORMING COMPOSITE IMAGES

[75] Inventors: Stephen C. Corona, Rochester; William L. Lama, Webster; Douglas W. Story, Rochester; Donald A. McTarnaghan, Webster; Gary A. Dir, Fairport, all of N.Y.

[73] Assignee: Xerox Corporation, Stamford, Conn.

[21] Appl. No.: 9,653

[22] Filed: Jan. 28, 1987

Related U.S. Application Data

[63] Continuation of Ser. No. 776,281, Sep. 16, 1985, abandoned.

[51] Int. Cl.[4] ..... G03G 15/00

[52] U.S. Cl. ..... 355/14 R; 355/7

[58] Field of Search ..... 355/14 R, 3 R, 7; 354/5

[56] References Cited

U.S. PATENT DOCUMENTS

| | | | |
|---|---|---|---|
| 3,824,604 | 7/1974 | Stein | 354/5 |
| 4,122,462 | 10/1978 | Hirayama et al. | 354/5 |
| 4,167,324 | 9/1979 | Wu | 355/3 R |
| 4,265,990 | 5/1981 | Stolka et al. | 430/59 |
| 4,318,610 | 3/1982 | Grace | 355/14 D |
| 4,385,822 | 5/1983 | Kanbe | 355/3 R |
| 4,472,050 | 9/1984 | Stockburger et al. | 355/40 |
| 4,551,008 | 11/1985 | Banton | 355/14 E |

FOREIGN PATENT DOCUMENTS 1564339 4/1980 United Kingdom .

OTHER PUBLICATIONS

"Electro-Printer with an Ion Station Therein", *IBM Tech. Disc. Bull.*, vol. 22, No. 12, May '80, pp. 5270–5271.

"Photolytic Tech. for Producing Microlenses in Photosensitive Glass", Borelli et al.; *Applied Optics*, vol. 24, No. 16, 15 Aug. 1985, pp. 2520–2525.

*Primary Examiner*—R. L. Moses

[57] ABSTRACT

An electrophotographic reproduction device is described which is capable of forming images of an original document modified by information added to or replacing information of the original. A latent image of the document is formed on a photosensitive surface and a portion of the image, in a first embodiment, is maintained at the original charge level. This fully charged section is subsequently discharged in an image-wise pattern by a compact annotator device. The annotator includes an illumination source, an addressable light modulator device such as a liquid crystal panel and a lens array for forming the modulated light pattern onto the photosensitive surface.

7 Claims, 4 Drawing Sheets

APPARATUS FOR FORMING COMPOSITE IMAGES

This is a continuation of application Ser. No. 776,281, filed Sept. 16, 1985, now abandoned.

BACKGROUND AND PRIOR ART

The present invention relates, generally, to an imaging system for an electrophotographic reproduction device and, more particularly, to an imaging system which forms, on a recording medium, a composite image of an original document, the exposed document image being modified by additional information added thereto by a supplemental imaging mechanism.

It is often desirable, when reproducing documents to modify the original content by, for example, adding supplemental text or pictorial information. Typical examples are the insertion of a company logo or address on each copy made. Some documents may also require identification control numbers, or page numbers, to be affixed thereto.

Composite images are formed in the known prior art by a variety of techniques. U.S. Pat. No. 4,167,324 (Wu) issued Sept. 11, 1979 discloses a technique whereby a latent image of an original document is formed on a photoreceptor by a light lens system along a first optical path while a modulated light beam input is directed along a second optical path to the surface of a stratified stylus belt. The belt is placed in proximity to the photoreceptor and acts to provide a charge pattern on the previously formed latent image in conformity with the information in the modulated laser input.

A second technique is disclosed in U.S. Pat. No. 4,385,822 (Kanbo) issued May 31, 1983. As disclosed therein, an electromagnetic recording medium is used which enables formation of a first electrostatic latent image in one layer thereof, as well as a second, magnetic latent image in a second layer thereof. The formation of the two images are synchronized and the composite latent image is subsequently developed by a specially designed developing device.

A third technique is to utilize an ion writing station as described in IBM Technical Disclosure Bulletin, Vol. 22, No. 12, May 1980, pp. 5270–5271. For this technique, a latent electrostatic image of the original document is formed by a light/lens optical arrangement. At a downstream position an ion writing station deposits a selected charge pattern on an already discharged portion of the latent image. This charge pattern conforms to the information desired to be added to the original document image.

These prior art techniques are subject to various problems and suffer from various disadvantages. The laser modulated systems are expensive and require significant space to house the various optical components. The ion generator and electromagnetic techniques are costly to implement and require stringent alignment procedures.

According to the present invention, there is provided a compact, inexpensive annotator device which modifies an original document image by adding or replacing information thereto. More particularly, the invention is directed to an apparatus for forming a composite latent image on a photosensitive surface, said composite image corresponding to informational areas contained on an original document and information added thereto, the apparatus comprising:

illumination and imaging means for forming a first latent image of an original document on a photosensitive recording medium, and annotator means adjacent said recording member for imposing a second latent image pattern within said first latent image area, said annotator means comprising:

an illumination source, partially enclosed by a light-collimating reflector, a two-dimensional lens array, a light modulating device positioned between said illumination source and said lens array and optically aligned therewith, and control means for periodically energizing said illumination source and for applying a modulation pattern to said modulating device, whereby a modulated light pattern is projected by said lens array onto said recording medium forming said second latent image information pattern.

Figure 1:
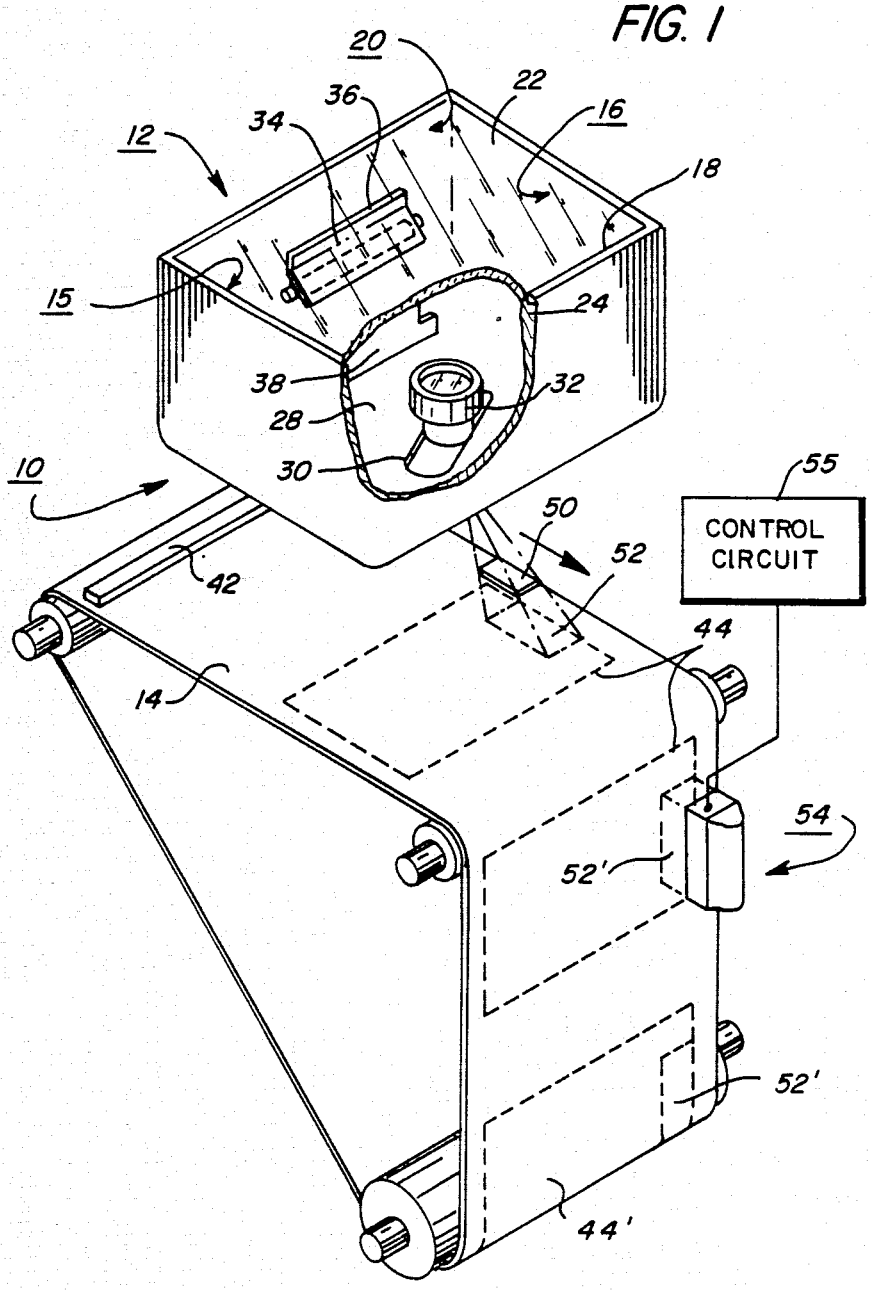
FIG. 1 is a partial perspective view of an illumination and imaging system showing a first embodiment of the compact annotation device of the present invention.

Referring now to FIG. 1, there is shown a full-frame illumination and imaging system utilizing the annotator device of the present invention. It is understood that the invention may be used in a variety of other electrophotographic document reproduction environments including an incremental line-by-line scanning system. FIG. 1 includes an integrating optical cavity 12 and a photorecptor belt 14 (only a portion of which is shown). Cavity 12 is a completely enclosed housing, generally rectangular in shape, having a first pair of opposing side walls 15, 16 and a second pair of opposing side walls 18, 20. An upper or top wall is formed by seating a glass platen 22 into aperture 24. The lower, or bottom wall 28 has an aperture 30 therein which accommodates a circular lens 32.

Mounted in side wall 20 is flash illumination lamp 34 which may be, for example, a Xenon gas lamp. The lamp is connected to pulsing circuitry (not shown) which, when activated, pulses the lamp, resulting in an illumination flash of appropriate duration. The interior walls of the cavity have substantially diffusely reflecting surfaces which cause the flashed light to undergo multiple reflectons from the walls, providing a uniform level of illumination at the underside of platen 22. Blockers 36 and 38 prevent direct light from reaching platen 22 and lens 32, respectively.

In operation, an original document to be copied (not shown) is placed on platen 22. Upon triggering of an illumination flash, the document is uniformly illuminated by the light, diffusely reflected from the cavity walls. The light rays are reflected from the document platen and are projected as a light image of the original document through lens 32 onto photoreceptor belt 14. The surface of belt 14 has been charged at a point prior to the exposure station to a uniform charge level by a corona generating device 42. As the light image of the document strikes the surface, informational areas are discharged to form an electrostatic latent image 44 conforming to the original document image.

An occluder 50 has been placed in the projected light path to prevent the discharge of area 52 contained within the document latent image area 44. Area 52 therefore remains at the fully charged level deposited by the corona generating device 42 and will serve, as described below, as the area upon which the supplemental information is to be added.

As the belt is moved in the indicated direction, it passes beneath annotator device 54. Device 54, under control of control circuit 55 described in connection with an explanation of FIG. 3 below, transmits a modulated light pattern onto area 52, the pattern conforming to the information to be added. Thus, a composite latent image 44' is created which consists of the original image 44 of the document formed during the light lens projection and the annotated area 52' which has a partially discharged charge pattern in conformance with the light pattern impinging thereon.

As the belt continues its movement, the belt passes through a developing station (not shown) where the composite latent image is developed by coating it with a finely divided electrostatically attractable powder referred to as a "toner". Thus, a toner image is produced in conformity with a light image of the document being reproduced as modified by the information added by annotator device 54. Generally, the developed image is then transferred to a suitable transfer member such as paper and the image is fused. The specific mechanics for accomplishing the development transfer and fusing are not shown but are well known in the art, e.g. U.S. Pat. No. 4,318,610 (Grace) issued Mar. 9, 1982 whose contents are hereby incorporated by reference.

Figure 2:
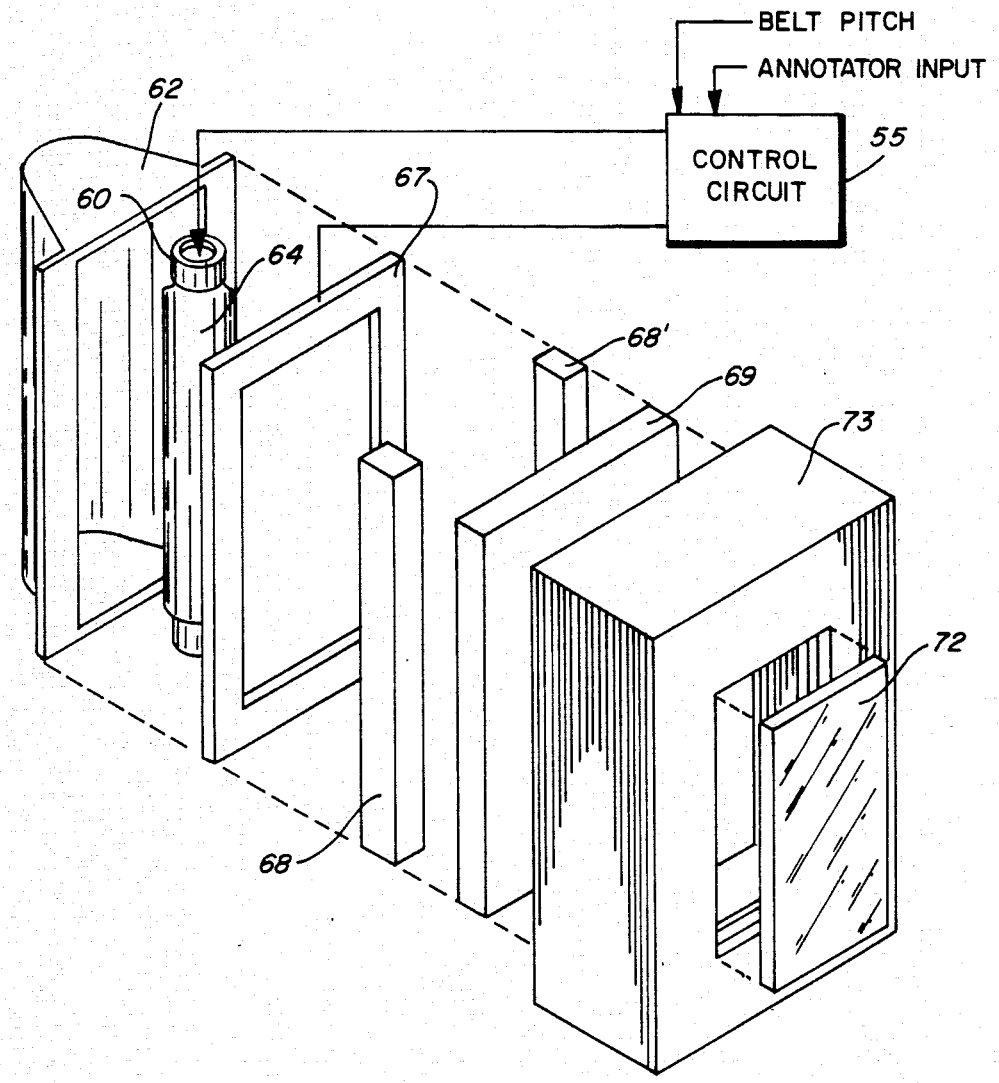
FIG. 2 shows an exploded view of the annotator device.

Referring now to FIG. 2, annotator device 54 is seen, in an exploded view, to comprise several optical elements formed into a compact, sandwich assembly. The assembly comprises, in combination, a light source 60 which, in a preferred embodiment, is a Xenon flash lamp. The lamp is maintained at some pre-flash power level by a power source (not shown). The lamp is centrally located beneath and at the approximate focus, of a high efficiency parabolic-shaped reflector 62. The lamp envelope is coated with a translucent Teflon layer 64 which acts as a lambertian emitter to reduce illumination non-uniformities caused by the glass wall of the lamp. The sleeve also functions as an electrical insulator to prevent the lamp trigger voltage from shorting to adjacent metal pieces. Positioned beneath the lamp is a conductive flex circuit 67 and an elastomer zebra strip 68,68; which together provide drive voltages to light modulator 69. Light from lamp 64 is partially collimated by reflector 62 and impinges on light modulator 69 which, in a preferred embodiment is a liquid crystal device. The transmitting state of the device 69 is determined by the input from control circuit 55 and represents the image information which it is desired to add to the original document content. The light modulator 69 is positioned proximate a two-dimensional lens array 72 which, in a preferred embodiment, is a thick lens array of the type described in Applied Optics Journal, August 18, 1985, pp. 2520–2525, whose contents are hereby incorporated by reference. Lens array 72, fixed within a lens mount 73, images the information placed electrically on the modulator 69 onto area 52 formed within latent image 44 frame. The lens array is designed to provide good resolution and illumination uniformity at the desired short total conjugate.

Thus, it is seen from the above description that the annotator device components are easily assembled along a centerline eliminating, or at least reducing, alignment procedures required for prior art devices. The components are formed within a compact space; typically with a 17 mm height when using a lens array with a 10 mm total conjugate.

In operation, and referring to FIGS. 1 and 2, previously formed latent image 44 proceeds in the indicated direction until the area 52, still fully charged because of the operation of occluder 50, passes beneath annotator device 54. Control circuit 55 receives belt pitch signals and an input signal representing the annotator information. When the belt 14 conveys area 52 into underlying alignment with lens array 72, circuit 55 provides an annotator input signal to LCD array 69, via strips 67, 68 and a trigger signal to lamp 60, causing the lamp to flash. The lamp is small and the required input energy is low (typically 0.3 joules/flash. As the lamp flashes, light is radiated directly from the lamp and indirectly via reflection from parabolic reflector 62. The reflector is designed to provide illumination of modulator 69 with the proper divergence. The divergence is low enough to yield high contrast with the annotator but high enough to maximize the throughput of the lens array.

Continuing with the operational description, the light from lamp 60 is partially collimated by reflector 62 and directed to the surface of modulator 69. The input from control circuit 55 has electrically formed an information pattern in the modulator whereby certain discrete segments remain opaque while others are changed to a transmissive (clear) state. The information content is thus contained in the transmissive segments; the partially collimated light passes through these areas and is imaged by lens 72 onto the surface of area 52. The charged surface of area 52 is thus discharged in the informational pattern created by the electrical input, resulting in an annotator area 52' and a composite latent image 44'. This composite image is subsequently developed and transferred to an output copy sheet.

The liquid crystal device 69 is designed to maximize contrast ratio and minimize transient response time. In a preferred embodiment, an optimized Hitachi LMO18 Display was used. Lens array 72 is designed with an acceptance angle which effectively limits the divergence angle of the light through the device 69, thereby maximizing the desirable properties of high contrast and fast transient speed of device 69.

The operation described above contemplated light from a single flash incident upon a modulator having a complete information pattern electrically imposed therein. It is possible, consistent with the principles of the invention, to form the composite information by incrementally forming a line of information along the process path of the photoreceptor. For this variation, the flash lamp would be sequentially flashed in synchronization with the rate of refreshed or modified information patterns formed by the modulator and with the photoreceptor velocity. Thus the informational portion of area 52 would be incrementally modified from the leading to the trailing edge.

Figure 3:
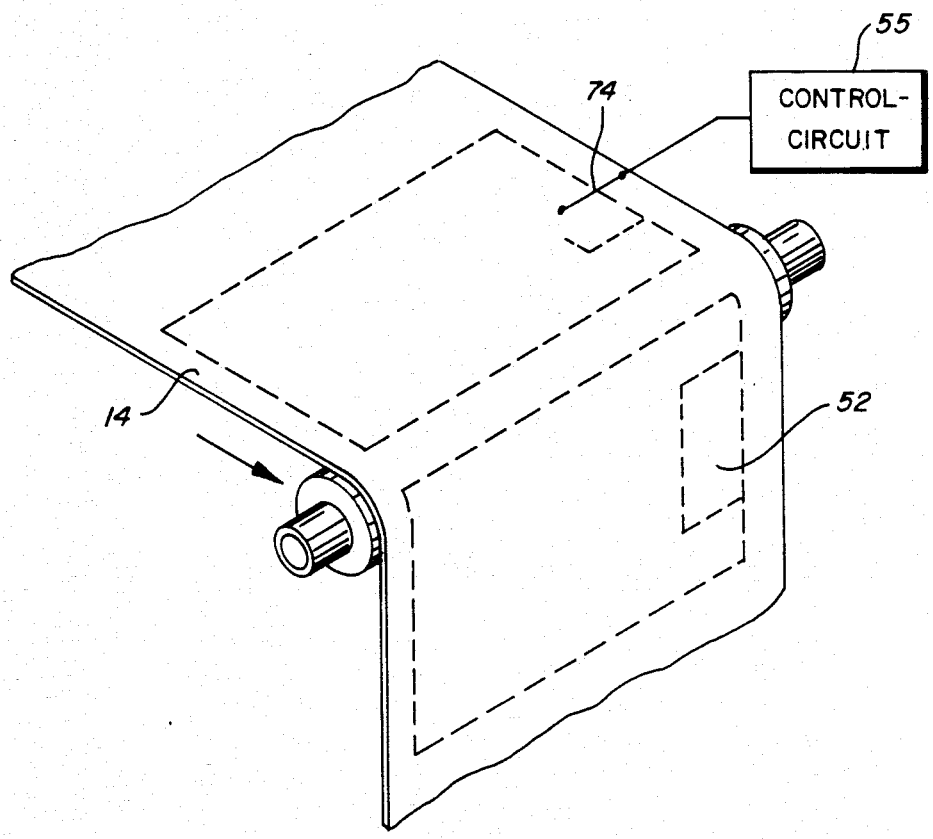
FIG. 3 shows an alternate means for preserving an annotator space within an original latent image.

According to a second aspect of the present invention, an alternative to forming the annotator area 52 by occluding a portion of the projected light is to first discharge and then recharge the desired annotation area. Thus, referring to FIGS. 1 and 3, occluder 50 would be removed from the optical path and the area 52 shown in FIG. 1 would be discharged in accordance with the original document content. Referring to FIG. 3, there is shown a corona generator device 74 whose operation is controlled by control circuit 55. Device 74 is activated, at the appropriate intervals, to place a uniform charge over the selected annotator area, thereby restoring that area to the fully charged state. As the belt proceeds in the indicated direction, area 52 passes within the domain of annotator 54 and is written upon as described above.

Figure 4:
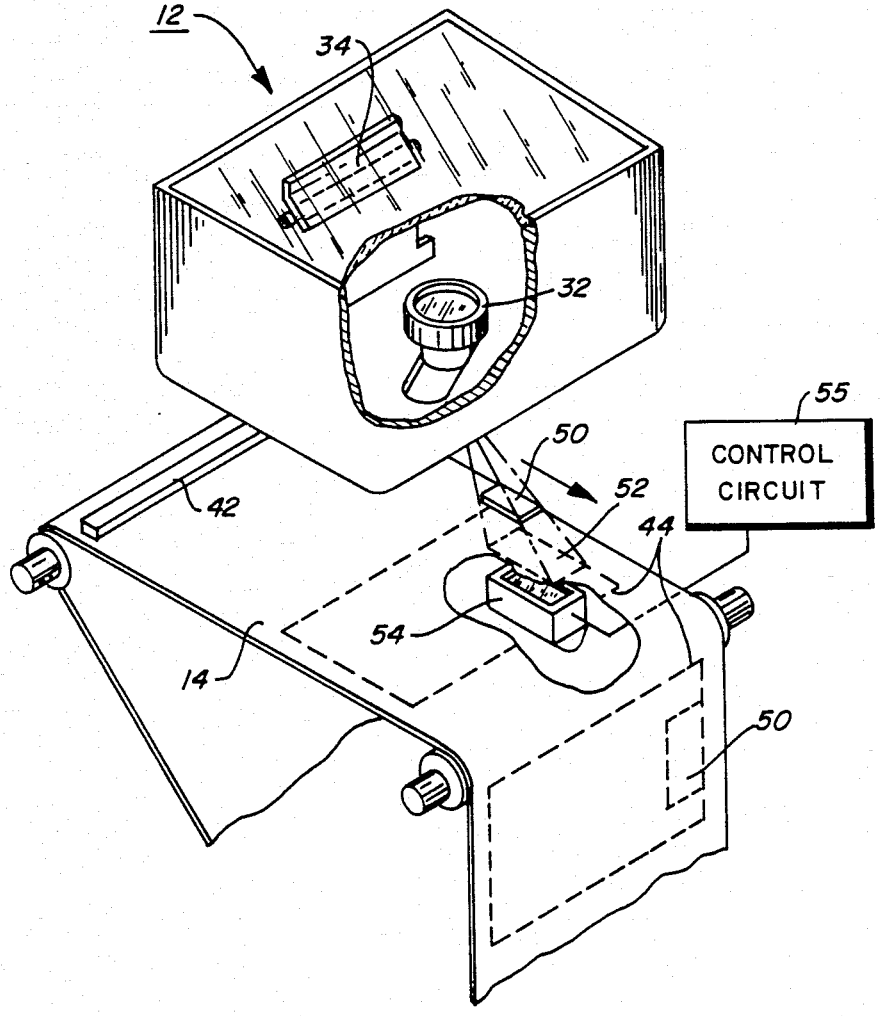
FIG. 4 shows another embodiment of the invention wherein the components of composite images are formed simultaneously.

The two embodiments described above were enabled by first forming a latent image and subsequently annotating a selected portion. It is also possible, according to a third aspect of the invention, to form a composite latent image simultaneously. This method requires that the photoreceptor belt 14 be optically transparent; an exemplary belt for this purpose is disclosed in U.S. Pat. No. 4,265,990 whose contents are hereby incorporated by reference. Referring to FIG. 4, annotator device 54 is now located beneath the surface of transparent belt 14. The operation of device 54 is now synchronized with the triggering of flash lamp 34. Occluder 50, as in the FIG. 1 embodiment prevents light from lamp 34 from impinging on area 52; this area is now discharged by annotator 52 in the informational pattern previously described. For this embodiment, the power requirements of annotator lamp 60 may be increased to compensate for light attenuation by belt 14.

The annotator device, as described and shown in the figures, assumed a rectangular shape. Other shapes and sizes to provide informational areas of varying widths are possible consistent with the principles of the invention. In other words, the dimensions of the information added to the original image is limited only by the dimensions of the annotator. The length of the added information in the process direction can be extended as desired, limited by the number of sequential flashes of the illumination lamps.

Other modification and changes may be made, consistent with the principles of the present invention. For example, the imaging system for the original document may include a scanning system wherein a document is incrementally scanned and a flowing image formed on the photoreceptor. As another example, or an alternate to using a Teflon sleeve over the lamp, the desired lambertian emission may be obtained by frosting the lamp envelope. As a still further example, the partial collimation may be accomplished by a collimating lens rather than the parabolic reflector design.

In summary, there has been disclosed a composite imaging system wherein the annotating device is extremely compact and designed for simple alignment in a system.

What is claimed is:

1. Apparatus for forming a composite latent image on a photosensitive surface, said composite image corresponding to informational areas contained on an original document and to information added thereto, the apparatus comprising:

illumination and imaging means for forming a first latent image of an original document on a photosensitive recording medium, an occluder positioned in the optical path during the formation of said first latent image to form an occluded area thereunder at an initial charge level, and annotator means for imposing a second latent image pattern within said first occluded area, said annotator means comprising:

an illumination source, a two-dimensional lens array, a light modulating device positioned between said illumination source and said lens array and optically aligned therewith, and control means for periodically energizing said illumination source and for applying a modulation pattern to said modulating device, whereby a modulated light pattern is projected by said lens array onto said occluded area of said first latent image.

2. The apparatus of claim 1 wherein the annotator means is located downstream from the first latent image formation station.

3. The apparatus of claim 1 wherein the photosensitive recording medium is transparent and wherein the annotator means is positioned beneath the medium and the control means simultaneously activates the first latent image illumination means and the annotator means illumination source.

4. The apparatus of claim 1 wherein said light modulating device is a liquid crystal array.

5. The apparatus of claim 1 wherein the illumination source is partially enclosed by a light-collimating reflector.

6. Apparatus for forming a composite latent image on a photosensitive surface, said composite image corresponding to informational areas contained on an original document and to information added thereto, the apparatus comprising:

illumination and imaging means for forming a first latent image of an original document on a photosensitive recording medium, a compact sandwich-type annotator means for imposing a second latent image pattern within said first latent image area, said annotator means comprising:

an illumination source, a two-dimensional lens array, a light modulating device positioned between said illumination source and said lens array and optically aligned therewith, and control means for periodically energizing said illumination source and for applying a modulation pattern to said modulating device, and whereby a modulated light pattern is projected by said lens array onto a portion of said first latent image on said recording medium forming said second latent image information pattern.

7. The apparatus of claim 6 wherein said illumination and imaging means include a full frame flash exposure means.

* * * * *